US006855853B2

(12) United States Patent
Groten et al.

(10) Patent No.: US 6,855,853 B2
(45) Date of Patent: Feb. 15, 2005

(54) PROCESS FOR THE PRODUCTION OF LOW BENZENE GASOLINE

(75) Inventors: Willibrord A. Groten, Houston, TX (US); Kerry L. Rock, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 156 days.

(21) Appl. No.: 10/353,331

(22) Filed: Jan. 29, 2003

(65) Prior Publication Data

US 2004/0055933 A1 Mar. 25, 2004

Related U.S. Application Data

(60) Provisional application No. 60/411,810, filed on Sep. 18, 2002.

(51) Int. Cl.[7] ..... C07C 5/02; C10G 65/02

(52) U.S. Cl. ..... 585/264; 585/258; 585/266; 208/210; 208/211; 208/212

(58) Field of Search ..... 585/258, 264, 585/266; 208/210, 211, 212

(56) References Cited

U.S. PATENT DOCUMENTS

| | | | | |
|---|---|---|---|---|
| 2,373,501 A | | 4/1945 | Peterson | 260/667 |
| 3,450,784 A | | 6/1969 | Reilly et al. | 260/667 |
| 3,912,787 A | | 10/1975 | Nowack et al. | 260/667 |
| 3,931,345 A | | 1/1976 | Gryaznov et al. | 260/667 |
| 4,079,092 A | | 3/1978 | Hayes et al. | 260/667 |
| 4,087,353 A | | 5/1978 | Rausch | 208/143 |
| 4,089,752 A | | 5/1978 | Hancock, II | 203/99 |
| 4,098,683 A | | 7/1978 | Conway | 208/216 |
| 4,108,912 A | | 8/1978 | Takemura et al. | 260/667 |
| 4,197,415 A | | 4/1980 | Hideyuki et al. | 585/23 |
| 4,215,011 A | | 7/1980 | Smith, Jr. | 252/426 |
| 4,225,418 A | | 9/1980 | Hilfman | 208/111 |
| 4,228,312 A | | 10/1980 | Noltes et al. | 585/250 |
| 4,240,900 A | | 12/1980 | Gilbert et al. | 208/143 |
| 4,327,234 A | | 4/1982 | Nowack et al. | 585/267 |
| 4,409,411 A | | 10/1983 | Pez | 585/275 |
| 4,731,496 A | | 3/1988 | Hu et al. | 585/270 |
| 4,857,666 A | | 8/1989 | Barger et al. | 585/323 |
| 5,003,118 A | | 3/1991 | Low et al. | 585/253 |
| 5,073,236 A | | 12/1991 | Gelbein et al. | 203/29 |
| 5,082,990 A | | 1/1992 | Hsieh et al. | 585/467 |
| 5,087,780 A | | 2/1992 | Arganbright | 585/259 |
| 5,189,233 A | | 2/1993 | Larkin et al. | 585/265 |
| 5,210,333 A | | 5/1993 | Bellows et al. | 585/827 |
| 5,210,348 A | | 5/1993 | Hsieh et al. | 585/253 |
| 5,246,567 A | | 9/1993 | Buttke et al. | 208/49 |
| 5,254,763 A | | 10/1993 | Gill et al. | 585/269 |
| 5,264,641 A | | 11/1993 | Borghard et al. | 585/269 |
| 5,266,546 A | | 11/1993 | Hearn | 502/300 |
| 5,368,691 A | | 11/1994 | Asselineau et al. | 203/29 |
| 5,431,890 A | | 7/1995 | Crossland et al. | 422/211 |
| 5,446,223 A | | 8/1995 | Smith, Jr. | 585/313 |
| 5,449,501 A | | 9/1995 | Luebke et al. | 422/193 |
| 5,595,634 A | | 1/1997 | Hearn et al. | 203/29 |
| 5,599,997 A | | 2/1997 | Hearn et al. | 564/450 |
| 5,628,880 A | | 5/1997 | Hearn et al. | 203/29 |
| 5,629,451 A | | 5/1997 | Hearn et al. | 564/490 |
| 5,773,670 A | | 6/1998 | Gildert et al. | 585/266 |
| 5,817,227 A | * | 10/1998 | Mikitenko et al. | 208/143 |
| 5,830,345 A | * | 11/1998 | Lee et al. | 208/92 |
| 5,856,602 A | | 1/1999 | Gildert et al. | 585/266 |
| 5,962,755 A | * | 10/1999 | Blommel et al. | 585/253 |
| 6,048,450 A | * | 4/2000 | Mikitenko et al. | 208/143 |
| 6,072,091 A | | 6/2000 | Cosyns et al. | 585/259 |
| 6,100,435 A | | 8/2000 | Silverberg et al. | 585/318 |
| 6,174,428 B1 | * | 1/2001 | Ambrosino et al. | 208/92 |
| 6,187,980 B1 | | 2/2001 | Gildert et al. | 585/266 |
| 6,261,442 B1 | * | 7/2001 | Ambrosino et al. | 208/92 |
| 6,444,118 B1 | * | 9/2002 | Podrebarac et al. | 208/210 |
| 6,540,907 B1 | * | 4/2003 | Towler et al. | 208/211 |
| 2003/0136706 A1 | * | 7/2003 | McDaniel et al. | 208/97 |

FOREIGN PATENT DOCUMENTS

| | | |
|---|---|---|
| EP | 0 552 070 | 7/1993 |

* cited by examiner

*Primary Examiner*—Walter D. Griffin
(74) *Attorney, Agent, or Firm*—Kenneth H. Johnson

(57) ABSTRACT

A process for the production of low benzene content gasoline is disclosed wherein a full boiling range naphtha is fractionated to produce a light naphtha, a medium naphtha and a heavy naphtha. The benzene is contained in the medium naphtha and this stream is subjected to hydrogenation to convert the benzene to cyclohexane which may be isomerized to improve the octane. The valuable olefins are removed in the light naphtha and the valuable heavier aromatics (toluene and xylenes) are removed in the heavy naphtha. In a preferred embodiment all of the reactions are carried out in distillation column reactors.

9 Claims, 2 Drawing Sheets

PROCESS FOR THE PRODUCTION OF LOW BENZENE GASOLINE

This application claims the benefit of provisional application 60/411,810 filed Sep. 18, 2002.

BACKGROUND OF THE INVENTION

1. Field of the Invention

The present invention relates to a process for the production of low benzene content gasoline. More particularly the invention relates to a process wherein a full boiling range naphtha is fractionated to separate out a light naphtha fraction, a medium naphtha fraction containing the benzene and a heavy naphtha. More particularly the invention relates to a process wherein the medium naphtha is hydrogenated to convert the benzene to cyclohexane.

2. Related Information

Petroleum distillate streams contain a variety of organic chemical components. Generally the streams are defined by their boiling range which determines the composition. The processing of the streams also affects the composition. For instance, products from either catalytic cracking or thermal cracking processes contain high concentrations of olefinic materials as well as saturated (alkanes) materials, aromatic compounds and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycyclic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane.

Catalytically cracked naphtha gasoline boiling range material currently forms a significant part (=⅓) of the gasoline product pool in the United States and it provides the largest portion of the sulfur. The sulfur impurities may require removal, usually by hydrotreating, in order to comply with product specifications or to ensure compliance with environmental regulations. Some users require the sulfur of the final product to be below 50 wppm. In addition the EPA requires that the benzene content of the gasoline be low, i.e., 1 vol. %.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \rightarrow RH+H_2S \quad (1)$$

$$RCl+H_2 \rightarrow RH+HCl \quad (2)$$

$$2RN+4H_2 \rightarrow 2RH+2NH_3 \quad (3)$$

$$ROOH+2H_2 \rightarrow RH+2H_2O \quad (4)$$

Typical operating conditions for the HDS reactions are:

| | |
|---|---|
| Temperature, ° F. | 600–780 |
| Pressure, psig | 600–3000 |
| $H_2$ recycle rate, SCF/bbl | 1500–3000 |
| Fresh $H_2$ makeup, SCF/bbl | 700–1000 |

After the hydrotreating is complete, the product may be fractionated or simply flashed to release the hydrogen sulfide and collect the now desulfurized naphtha. The loss of olefins by incidental hydrogenation is detrimental by the reduction of the octane rating of the naphtha and the reduction in the pool of olefins for other uses.

Generally refiners tend to prevent benzene from entering the gasoline blending stock. For example as mentioned above the cracked naphthas may be subjected to aromatic removal by solvent extraction. This, however, removes all aromatic material not just the benzene. One method of preventing the introduction of benzene into the gasoline pool is to remove the benzene precursor (isohexane) from the charge to the catalytic reforming units. This does not solve the problem of streams which contain benzene as well as heavier aromatic compounds such as toluene and xylenes. The heavier aromatics contribute greatly to the octane pool and to date have not been found to be detrimental to the environment.

U.S. Pat. No. 5,7734,670 discloses a process for the hydrogenation of aromatics in a petroleum stream. However, like solvent extraction, the process is not selective to only the benzene. U.S. Pat. No. 5,856,602, discloses the hydrogenation of aromatics in a hydrocarbon stream utilizing a distillation column reactor wherein the placement of the catalyst bed and operation of the distillation column controls which aromatic is retained in the catalyst bed for hydrogenation. U.S. Pat. No. 6,187,980 B1 discloses a process for the hydrogenation of benzene to cyclohexane in a distillation column reactor wherein essentially pure benzene is used as the feed to the reactor.

In addition to supplying high octane blending components the cracked naphthas are often used as sources of olefins in other processes such as etherification. The conditions of hydrotreating of the naphtha fraction to remove sulfur will also saturate some of the olefinic compounds in the fraction reducing the octane and causing a loss of source olefins.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction the most common solution has been prefractionation prior to hydrotreating. The prefractionation produces a light boiling range naphtha which boils in the range of $C_5$ to about 250° F. and a heavy boiling range naphtha which boils in the range of from about 250–450° F.

The predominant light or lower boiling sulfur compounds are mercaptans while the heavier or higher boiling compounds are thiophenes and other heterocyclic compounds. The separation by fractionation alone will not remove the mercaptans. In the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

U.S. Pat. No. 5,510,568 discloses a process in which naphtha is fed to a distillation column reactor which acts as a depentanizer or dehexanizer with the lighter material containing most of the olefins and mercaptans being boiled up into a distillation reaction zone where the mercaptans are reacted with diolefins to form sulfides which are removed in the bottoms along with any higher boiling sulfur compounds.

SUMMARY OF THE INVENTION

Briefly, the present invention is a process for the production of low benzene content gasoline comprising fractionating a full boiling range naphtha to produce a light naphtha containing olefins, a medium naphtha containing benzene and a heavy naphtha containing toluene and xylenes and hydrogenating said medium naphtha to convert the benzene to cyclohexane. The cyclohexane may be isomerized to improve the octane. Preferably all of the reactions are carried out under conditions of catalytic distillation.

As used herein the term "catalytic distillation" means a reaction carried out with a catalyst such that reaction and distillation are going on concurrently. In a preferred embodiment the catalyst is prepared as a distillation structure and serves as both the catalyst and distillation structure.

DETAILED DESCRIPTION OF THE INVENTION

Figure 1:
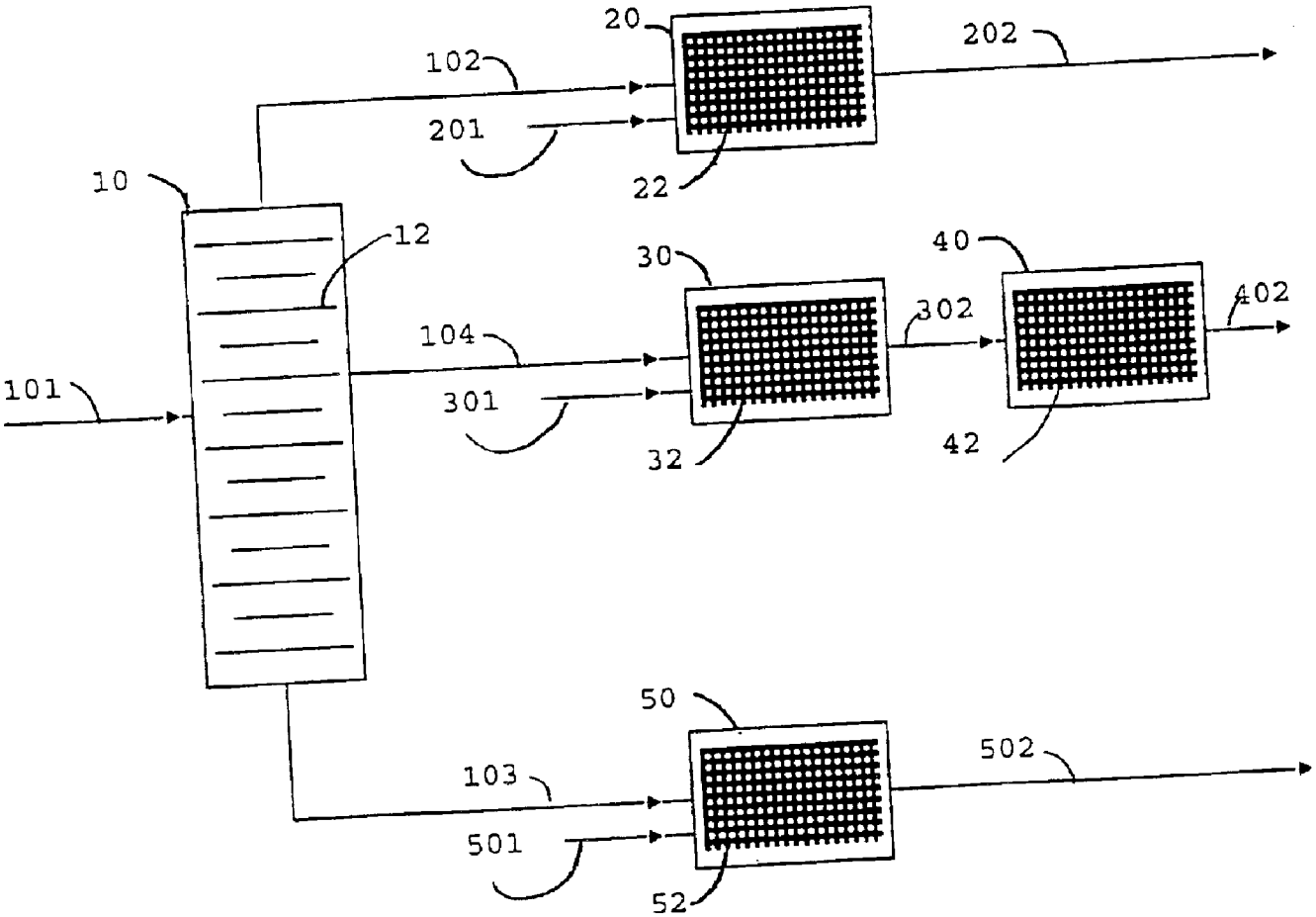
FIG. 1 is a flow diagram in schematic form of one embodiment of the present invention.

The feed to the process comprises a benzene-containing petroleum fraction which boils in the gasoline boiling range ($C_5$ to 450° F. or full boiling range naphtha). The fraction can be from a catalytic reforming unit or from a fluid catalytic cracking unit. Generally the process is useful on the naphtha boiling range material from catalytic cracker products because they contain the desired olefins and heavier aromatic compounds and the unwanted benzene. In addition the cracked naphthas also contain unwanted sulfur compounds which are removed in one embodiment of the invention. Straight run naphthas have very little olefinic material, and unless the crude source is "sour", very little sulfur.

Both full boiling range reformed naphtha and full boiling range cracked naphtha have significant quantities of the heavier aromatics.

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The front end of the naphtha contains most of the high octane olefins but relatively little of the sulfur. The sulfur components in the front end are mainly mercaptans and typical of those compounds are: methyl mercaptan (b.p. 43° F.), ethyl mercaptan (b.p. 99° F.), n-propyl mercaptan (b.p. 154° F.), iso-propyl mercaptan (b.p. 135–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), isoamyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes sulfides and disulfides.

The reaction of organic sulfur compounds in a refinery stream with hydrogen over a catalyst to form $H_2S$ is typically called hydrodesulfurization. Hydrotreating is a broader term which includes saturation of olefins and aromatics and the reaction of organic nitrogen compounds to form ammonia. However hydrodesulfurization is included and is sometimes simply referred to as hydrotreating.

The lower boiling portion of the naphtha which contains most of the olefins is therefore not subjected to hydrodesulfurization catalyst but to a less severe treatment wherein the mercaptans contained therein are reacted with diolefins contained therein to form sulfides (thioetherification) which are higher boiling and can be removed with the heavier naphtha. The thioetherification reactor can be either before or after a catalytic distillation hydrodesulfurization reactor so long as the hydrodesulfurization occurs in the stripping section of the catalytic distillation hydrodesulfurization reactor such that the lower boiling point materials are not contacted with the hydrodesulfurization catalyst.

Thioetherification Catalysts

A suitable catalyst for the thioetherification reaction is 0.34 wt. % Pd on 7 to 14 mesh $Al_2O_3$ (alumina) spheres, supplied by Sud-Chemie designated as G-68C. Typical physical and chemical properties of the catalyst as provided by the manufacturer are as follows:

TABLE I

| | |
|---|---|
| Designation | G-68C |
| Form | Sphere |
| Nominal size | 7 × 14 mesh |
| Pd. wt % | 0.3 (0.27–0.33) |
| Support | High purity alumina |

The catalyst is believed to be the hydride of palladium which is produced during operation. The hydrogen rate to the reactor must be sufficient to maintain the catalyst in the active form because hydrogen is lost from the catalyst by hydrogenation, but kept below that which would cause flooding of the column which is understood to be the "effectuating amount of hydrogen" as that term is used herein. Generally the mole ratio of hydrogen to diolefins and acetylenes in the feed is at least 1.0 to 1.0 and preferably 2.0 to 1.0.

The thioetherification catalyst also catalyzes the selective hydrogenation of polyolefins contained within the light cracked naphtha and to a lesser degree the isomerization of some of the mono-olefins. Generally the relative rates of reaction for various compounds are in the order of from faster to slower:

(1) reaction of diolefins with mercaptans (2) hydrogenation of diolefins (3) isomerization of the mono-olefins (4) hydrogenation of the mono-olefins.

The reaction of interest is the reaction of the mercaptans with diolefins. In the presence of the catalyst the mercaptans will also react with mono-olefins. However, there is an excess of diolefins to mercaptans in the light cracked naphtha feed and the mercaptans preferentially react with them before reacting with the mono-olefins. The equation of interest which describes the reaction is:

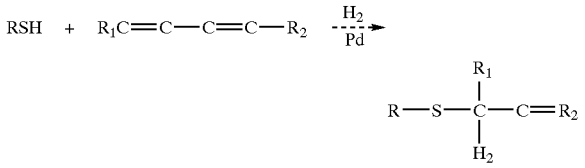

This may be compared to the HDS reaction described below which consumes hydrogen. The only hydrogen consumed in the removal of the mercaptans in the present invention is that necessary to keep the catalyst in the reduced "hydride" state. If there is concurrent hydrogenation of the dienes, then hydrogen will be consumed in that reaction.

HDS and Hydrogenation Catalyst

A preferable catalyst for the hydrogenation of benzene and the destructive hydrogenation of the sulfur compounds (hydrodesulfurization) is 58 wt % Ni on 8 to 14 mesh alumina spheres, supplied by Calcicat, designated as E-475-SR. Typical physical and chemical properties of the catalyst as provided by the manufacturer are as follows:

TABLE II

| | |
|---|---|
| Designation | E-475-SR |
| Form | Spheres |
| Nominal size | 8 × 14 Mesh |
| Ni wt % | 54 |
| Support | Alumina |

Catalysts which are useful for either the hydrogenation of benzene or the hydrodesulfurization reaction include Group VIII metals such as cobalt, nickel, palladium, alone or in combination with other metals such as molybdenum or tungsten on a suitable support which may be alumina, silica-alumina, titania-zirconia or the like. Normally the metals are provided as the oxides of the metals supported on extrudates or spheres and as such are not generally useful as distillation structures.

The catalysts may additionally contain components from Group V and VIB metals of the Periodic Table or mixtures thereof. The use of the distillation system reduces the deactivation and provides for longer runs than the fixed bed hydrogenation units of the prior art. The Group VIII metal provides increased overall average activity. Catalysts containing a Group VIB metal such as molybdenum and a Group VIII such as cobalt or nickel are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are reduced to the sulfide either in use or prior to use by exposure to sulfur compound containing streams.

The properties of a typical hydrodesulfurization catalyst are shown in Table I below.

TABLE III

| | |
|---|---|
| Manufacturer | Criterion Catalyst Co. |
| Designation | C-448 |
| Form | Tri-lobe Extrudate |
| Nominal size | 1.2 mm diameter |
| Metal, Wt. % | |
| Cobalt | 2–5% |
| Molybdenum | 5–20% |
| Support | Alumina |

The catalyst typically is in the form of extrudates having a diameter of ⅛, 1/16or 1/32 inches and an L/D of 1.5 to 10. The catalyst also may be in the form of spheres having the same diameters. In their regular form they form too compact a mass and are preferably prepared in the form of a catalytic distillation structure. The catalytic distillation structure must be able to function as catalyst and as mass transfer medium.

Isomerization Catalyst

Typically isomerization catalysts are of the Freidel Crafts chlorided alumina catalyst having a Group VIII, particularly platinum. Such catalysts are well known in the art and are discussed in U.S. Pat. No. 4,783,575 which is incorporated herein by reference.

Catalytic Distillation Structure

When the catalysts are used within a distillation column reactor, they are preferably prepared in the form of a catalytic distillation structure. The catalytic distillation structure must be able to function as catalyst and as mass transfer medium. The catalyst must be suitably supported and spaced within the column to act as a catalytic distillation structure. Catalytic distillation structures useful for this purpose are disclosed in U.S. Pat. Nos. 4,731,229, 5,073,236, 5,431,890 and 5,266,546 which are incorporated by reference.

The most preferred structure is that shown in U.S. Pat. No. 5,730,843 which is incorporated by reference. As disclosed therein the structure comprises a rigid frame made of two substantially vertical duplicate grids spaced apart and held rigid by a plurality of substantially horizontal rigid members and a plurality of substantially horizontal wire mesh tubes mounted to the grids to form a plurality of fluid pathways among the tubes. At least a portion of the wire mesh tubes contain a particulate catalytic material. The catalyst within the tubes provides a reaction zone where catalytic reactions may occur and the wire mesh provides mass transfer surfaces to effect a fractional distillation. The spacing elements provide for a variation of the catalyst density and loading and structural integrity.

Process Conditions

Conditions for the hydrogenation of benzene to cyclohexane in a single pass downflow fixed bed reactor are known in the art. Temperatures of about 400° F. and pressures in the range of 300–500 psig are adequate when using a nickel catalyst. However, copious quantities of hydrogen, especially between beds, are need to control the temperature of the highly exothermic reaction. Conditions in a distillation column reactor are considerably different. Catalyst bed temperatures of between 250 and 300° F. at pressures of about 75 psig (about 30 psia hydrogen partial pressure) are adequate. In addition the boiling of the liquid within the bed dissipates the heat of reaction which is removed in the overheads by condensation and reflux.

Process conditions for standard hydrodesulfurization of a fluid cracked naphtha stream are also known. Temperatures in the range of about 600–700° F. along with pressures in the range of 700–1000 psig and space velocities in the range of 1–10 volume of naphtha per unit volume of catalyst. Hydrogen rates in the range of 1000 to 1500 standard cubic foot per barrel of feed are commonly used.

Process for the conditions for the hydrodesulfurization of a heavy fluid cracked naphtha stream in a distillation column reactor include temperatures in the range of 500° F. and pressures sufficient to keep a portion of the naphtha in the liquid state (boiling) or about 200–300 psig. Hydrogen rates similar to that in standard units are suitable.

Process conditions for the thioetherification of a light naphtha in a standard fixed bed reactor are about 150 psig pressure, about 300° F., and a 10 WHSV (weight hourly space velocity, in wt of feed per wt of catalyst per hour, $hr^{-1}$). About 6.25 volume of hydrogen per volume of feed is useful to keep the catalyst in the hydride state.

Conditions in a distillation column used as a thioetherification reactor include about 125 psig overhead pressure, middle catalyst bed temperature of about 265° F. with hydrogen feed at about the same as for the standard reactor.

The isomerization of cyclohexane to higher octane components is disclosed in U.S. Pat. No. 4,783,575 which is incorporated herein by reference. Generally the cyclohexane ring is first broken and isomerized to isohexane. Any methyl cyclo pentane can also be converted to isohexane. The conditions include 290–440° F. with pressures of about 370 psig. Space velocities of 0.5 to 3 are preferred. Hydrogen is fed in an amount to provide a molar ratio of from 0.01 to 10 moles of hydrogen per mole of hydrocarbon in the outlet of the reactor. These conditions are suitable for both standard fixed bed operation and distillation column reactor.

Referring now to the figures specific embodiments of the process of the invention are shown.

In FIG. 1 there is shown a generic process scheme to produce low benzene content gasoline while at the same time reducing the sulfur levels. The full boiling range naphtha is fed via flow line 101 to a distillation column 10 having standard distillation structure 12 contained therein. The standard distillation structure may be sieve trays, valve trays, bubble cap or packing as is normal in the industry. A light naphtha boiling below the boiling point of benzene (about 175° F. and lighter) is taken as overheads via flow line 102. A mid range naphtha boiling in the range of about 170 to 180° F. is taken as a side draw via flow line 104. This mid range naphtha contains the benzene which has a boiling point of 176° F. The range is necessary to insure that all of the benzene is removed. A heavy naphtha is boiling above the boiling point of benzene (about 180° F. and heavier) is taken as bottoms via flow lined 103. The bottoms will contain any octane rich toluene and xylenes.

The light naphtha may contain valuable olefins but also diolefins and organic sulfur compounds which are mostly mercaptans. To remove the mercaptans the naphtha can be subjected to a typical sweetening process such as MEROX or by reaction with the diolefins over a thioetherification catalyst 22 in a thioetherification reactor 20. Hydrogen is added to the thioetherification reactor via flow line 201 and product is removed via flow line 202.

The mid range naphtha in flow line 104 is subjected to hydrogenation in a hydrogenation reactor 30 containing a hydrogenation catalyst 32 with hydrogen being added via flow line 301. The mid range naphtha may also contain organic sulfur compounds which would generally be thiophene in the boiling range taken. The hydrogenation catalyst also acts as a hydrodesulfurization catalyst to convert the thiophene to hydrogen sulfide at the same time as the benzene is converted to cyclohexane. The mid range naphtha having reduced benzene content is removed via flow line 302 and may then be subjected to isomerization catalyst 42 in isomerization reactor 40 to improve the octane with product being removed via flow line 402.

The heavy naphtha in the bottoms may be subjected to hydrodesuflurization in reactor 50 containing hydrodesulfurization catalyst 52 with hydrogen being added via flow line 501. Desulfurized heavy naphtha is removed via flow line 502. If desire all of the product streams in flow lines 202, 402 and 502 can be combined to produce a gasoline which is low in benzene and sulfur.

Figure 2:
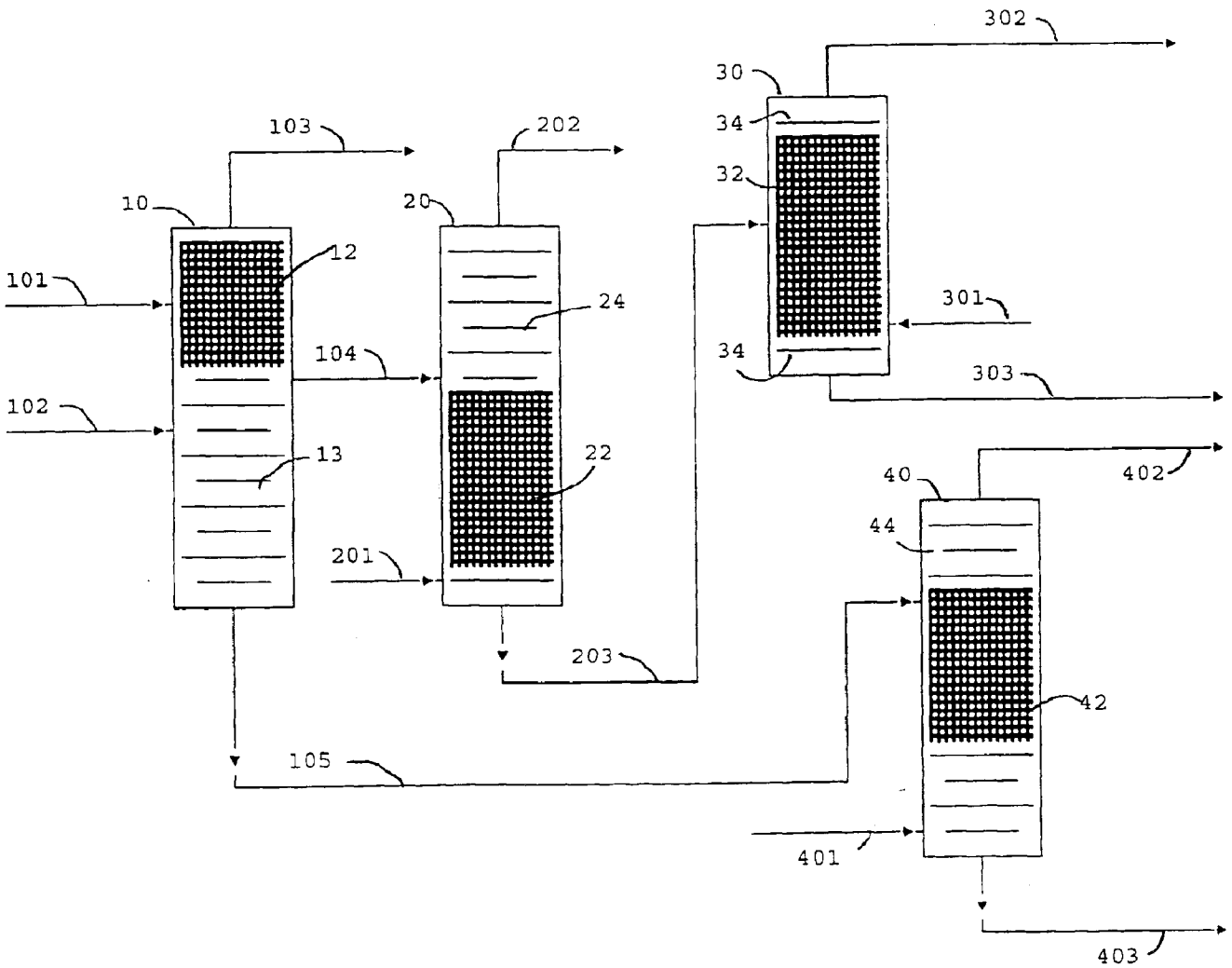
FIG. 2 is a flow diagram in schematic form of a second embodiment of the present invention.

Referring now to FIG. 2 a preferred embodiment of the invention is shown. A first distillation column reactor 10 is shown to contain a bed 12 of thioetherification catalyst in the rectification section. The remainder of the column contains standard distillation structure 13 as discussed above. The full range naphtha is fed to the distillation column 10 via flow line 101 with the hydrogen necessary to keep the thioetherification catalyst in the hydrided state being supplied via flow line 102. The diolefins within the light naphtha react with the mercaptans to form sulfides which are distilled downward and removed in the bottoms. The now low sulfur light naphtha which boils below the boiling point of benzene (about 170° F. and lighter) is removed as overheads via flow line 103.

A mid range naphtha boiling in the range of 170–180° F. is taken as a side draw via flow line 104 and fed to a second distillation column reactor 20 which contains a bed 22 of hydrogenation catalyst with hydrogen being fed flow line 201. The rectification section of the distillation column contains standard distillation structure 24 as discussed above. Any lighter naphtha boiling below the boiling point of benzene or cyclohexane (about 174° F. and lighter) and containing valuable olefins is stripped out of the mid range naphtha and removed as overheads via flow line 202 along with the hydrogen sulfide produced. The remainder of the mid range naphtha containing the benzene and possible thiophene is subjected to hydrogenation in the lower portion of the column wherein benzene is converted to cyclohexane and thiophene is converted to hydrogen sulfide. The mid range naphtha now stripped of any lighter products and containing less benzene and thiophene is removed a bottoms via flow line 203.

The bottoms from the hydrogenation distillation column reactor in flow line 203 are fed to a third distillation column reactor 30 containing a bed of 32 of isomerization catalyst and standard distillation structure 34. In the reactor 30 the cyclohexane is isomerized to higher octane product such as methyl cyclopentane or isohexane. The advantage of the concurrent distillation is that the isomerization product is removed from the catalyst bed 32 as fast as it is formed thus improving the overall production of the isomers. An overheads is taken via flow line 302 with bottoms containing the isomerization product being taken via flow line 303. If hydrogen is needed, it is supplied via flow line 301. If necessary a second bed (not shown) of hydrodesulfurization catalyst may be used to convert the thiophene to hydrogen sulfide.

The bottoms, containing the heavy naphtha including the heavier aromatic material such as toluene and xylenes is removed via flow line 105 and fed to fourth distillation column reactor 40 containing a bed 42 of hydrodesulfurization catalyst. Hydrogen is added via flow line 401. Standard distillation structure 44 may be disposed above and below the bed 42. The heavier organic sulfur compounds contained within the heavy naphtha are reacted with hydrogen to produce hydrogen sulfide. The distillation is run not so much for separation but to provide a condensing liquid within the bed 42 which allows for use of lower hydrogen partial pressures than otherwise be necessary. An overheads is taken via flow line 402 and a bottoms via flow line 403. The overheads liquid product may be totally recycled as reflux after the hydrogen sulfide and excess hydrogen are removed.

If desired all of the naphtha products in flow lines 202, 302, 303, 402 and 403 may be combined to produce a low benzene low sulfur gasoline.

The invention claimed is:

1. A process for producing low benzene content gasoline corn rising the steps of:

(a) feeding a full boiling range naphtha containing benzene, olefins, diolefins, mercaptans, thiophenes and other organic sulfur compounds to a distillation column wherein a light naphtha fraction is taken as overheads, a medium naphtha fraction containing said benzene is taken as a side draw and a heavy naphtha fraction is taken as a bottoms;

(b) feeding said medium naphtha fraction containing said benzene and said thiophenes to a hydrogenation reactor containing a hydrogenation catalyst wherein a portion of said benzene is hydrogenated to cyclohexane and said thiophenes are converted to hydrogen sulfide;

(c) combining said overheads, said bottoms and the effluent from said hydrogenation reactor to produce a gasoline lower in benzene content than said full boiling range naphtha feed;

(d) feeding said overheads to a thioetherification react r containing a thioetherification catalyst wherein a portion of said diolefins are react d with a portion of said mercaptans to produce sulfides;

(e) separating said sulfides from said overheads;

(f) feeding said bottoms and hydrogen to a hydrodesulfurization reactor containing a hydrodesulfurization catalyst wherein a portion of said other organic sulfur compounds are reacted with hydrogen to produce hydrogen sulfide; and (g) separating said hydrogen sulfide from said bottoms.

2. The process according to claim 1 wherein the effluent from said hydrogenation reactor is fed to an isomerization reactor containing an isomerization catalyst wherein a portion of said cyclohexane is isomerized to methyl cyclo pentane.

3. The process according to claim 2 wherein said distillation column contains said thioetherification catalyst and said sulfides are remove along with said bottoms.

4. The process according to claim 2 wherein said hydrogenation catalyst is contained within a second distillation column and any material boiling at a temperature below that of benzene or cyclohexane is removed as a second overheads and any material boiling at or above the boiling point of benzene an cyclohexane is removed as a second bottoms.

5. The process according to claim 2 wherein said hydrodesulfurization catalyst is contained within a third distillation column and the hydrodesulfurization reaction is carried out simultaneously with distillation.

6. The process according to claim 2 wherein sa d isomerization catalyst is contained within a fourth distillation column and the isomerization reaction is carried out simultaneously with distillation.

7. A process for the production of low sulfur, low benzene content gasoline comprising the steps of:

(a) feeding hydrogen and a full boiling range naphtha containing olefins, benzene, diolefins, mercaptans, thiophenes and other organic sulfur compounds to a first distillation column reactor containing a thioetherification catalyst;

(b) concurrently in said first distillation column reactor;

(i) contacting said diolefins with said mercaptans in the presence of said thioetherification catalyst to react a portion of said diolefins with portion of said mercaptans to produce sulfides, and (ii) fractionating said full boiling range naphtha to produce a light naphtha, medium naphtha containing said benzene and said thiophene and heavy naphtha;

(c) removing said light naphtha from said first distillation column reactor as a first overheads;

(d) removing said medium naphtha from said first distillation column reactor as a side draw;

(e) removing said heavy naphtha from said first distillation column reactor as a first bottoms;

(f) feeding hydrogen and said medium naphtha to a second distillation column reactor containing a hydrogenation catalyst;

(g) concurrently in said second distillation column reactor;

(i) contacting the benzene and thiophene contained within said medium naphtha with hydrogen in the presence of said hydrogenation catalyst to hydrogenate a portion of said benzene to cyclohexane and to react a portion of said thiophene with said hydrogen to produce hydrogen sulfide, and (ii) fractionating said medium naphtha to separate said hydrogen sulfide and any material boiling at a temperature below that of benzene or cyclohexane from any material boiling at or above the boiling point of benzene and cyclohexane;

(h) removing said hydrogen sulfide and the material boiling a temperature below that of benzene or cyclohexane as a second overheads; and (i) removing any material boiling at or above the boiling point of benzene and cyclohexane as a second bottoms.

8. The process according to claim 7 further comprising feeding said second bottoms to a third distillation column reactor containing an isomerization catalyst and concurrently in said third distillation column reactor:

(a) isomerizing a portion of said cyclohexane to methyl cyclo pentane to form a reaction mixture; and (b) separating the isomerization product from the reaction mixture by fractional distillation.

9. The process according to claim 7 further comprising feeding hydrogen and said first bottoms to a fourth distillation column reactor containing a hydrodesulfurization catalyst and concurrently in said fourth distillation column reactor:

(a) reacting a portion of said heavier organic sulfur compounds with hydrogen to form hydrogen sulfide; and (b) separating hydrogen sulfide from the heavy naphtha by distillation.

* * * * *